United States Patent [19]

Burlington et al.

[11] Patent Number: 4,919,345

[45] Date of Patent: Apr. 24, 1990

[54] SHREDDING MACHINES

[75] Inventors: Geoffrey M. Burlington, East Sussex; Stephen C. Watkins, Worcestershire, both of United Kingdom

[73] Assignee: Ofrex Group Holdings PLC, England

[21] Appl. No.: 298,030

[22] Filed: Jan. 18, 1989

[30] Foreign Application Priority Data

Feb. 25, 1988 [GB] United Kingdom ..... 8804437

[51] Int. Cl.[5] ..... B02C 25/00

[52] U.S. Cl. ..... 241/36; 241/101.2; 241/236

[58] Field of Search ..... 241/101.2, 100, 36, 241/236

[56] References Cited

U.S. PATENT DOCUMENTS 4,043,514 8/1977 Peterson ..... 241/36

FOREIGN PATENT DOCUMENTS 3302049 7/1984 Fed. Rep. of Germany ... 241/101.2
3619126 8/1987 Fed. Rep. of Germany ..... 241/100
3712562 5/1988 Fed. Rep. of Germany ... 241/101.2
2167312 5/1986 United Kingdom ..... 241/101.2

OTHER PUBLICATIONS

Roto-Shear, Shredding Systems Inc, 5-10-83.

*Primary Examiner*—Mark Rosenbaum
*Attorney, Agent, or Firm*—Kirschstein, Ottinger, Israel & Schiffmiller

[57] ABSTRACT

In a shredding machine, oppositely rotating cutter shafts (11*a*, 11*b*) are driven by an electric motor (E) through an epicyclic gear mechanism (G) comprising a casing (17) with an internal gear formation (52) and a planet carrier (31) carrying planet gears (34) in mesh with the internal gear formation (52), the motor (E) driving a sun gear (35) in mesh with the planet gears (34), the drive to the cutter shafts (11*a*, 11*b*) being from the planet carrier (31). Preferably there are two planet carriers (31, 37), the planet gears (33) of the second carrier (37) being driven by a sun gear (32) driven by the first planet carrier (31), the cutter shafts (11*a*, 11*b*) being driven from the second planet carrier (37). One of the shafts (11*b*) is driven directly, and the other (11*a*) through further gearing (66, 38). The casing (17) is mounted for limited movement under high load, a switch (90) being provided to detect such movement, to stop or reverse the motor (E).

10 Claims, 2 Drawing Sheets

SHREDDING MACHINES

BACKGROUND OF THE INVENTION

This invention is concerned with shredding machines, particularly of the kind (hereinafter referred to as being of the kind specified) comprising a cutter assembly comprising parallel cutter shafts on each of which a plurality of cutter discs are mounted, the discs of one shaft being arranged to enter gaps between the discs of the other shaft with little or no clearance and the shafts being rotated in opposite directions so that the overlapping discs collectively act to cut material fed into the nip of the cutter assembly into narrow strips.

Difficulty is encountered in shredding machines of the kind specified in the provision of an electric motor which will drive the cutter shafts at an appropriately low speed and an appropriately high torque.

Whilst electric motors are readily available which provide high speed and low torque, difficulty has been encountered in utilising such motors. Thus, it has been general practice to utilise motors operable to deliver a higher torque at a lower speed.

SUMMARY OF THE INVENTION

According to this invention there is provided a shredding machine of the kind specified in which the shafts are driven by an electric motor through the intermediary of an epicyclic gear mechanism.

By the use of an epicyclic gear mechanism an adequately high torque at an adequately low speed may be obtained from a conventional high speed electric motor without undue loss in power, and with a minimum of space being taken up by the gear mechanism. Thus the gear mechanism may be predominantly contained within a casing secured to a housing for the cutter mechanism, one of the shafts being driven directly from the gear mechanism, the other shaft being driven by further gearing internally of the housing.

Preferably the casing is provided with a toothed formation on the interior thereof, with which planet gears of the epicyclic gear mechanism engage, and the casing is constrained against rotation relative to a frame member (such as the housing), but is permited a limited freedom to rotate under high load, such as would occur when the cutter mechanism becomes jammed.

Preferably the machine comprises means to sense such movement of the casing, to switch off or reverse the electric motor.

According to this invention there is also provided a shredding machine of the kind specified comprising an electric motor and gear mechanism operative between the motor and the cutter shafts to drive the cutter shafts in opposite directions, the gear mechanism comprising a casing secured to the machine housing, the casing comprising a hollow cylindrically disposed internal gear formation, a planet carrier rotatably mounting a plurality of planet gears within the casing in mesh with the casing internal gear formation, drive means extending axially with the casing and rotated by the electric motor, the drive means comprising a sun gear in mesh with the planet gears.

The planet carrier may be connected directly with one of the shafts, drive for the other shaft being afforded by further gearing of the mechanism including a drive pinion secured to said planet carrier and a driven pinion in mesh with said drive pinion connected to the second cutter shaft.

Preferably however the gearing comprises a second planet carrier rotatably mounting a plurality of planet gears within the casing in mesh with the casing internal gear formation, the first planet carrier carrying a sun gear in mesh with the planet gears of the second planet carrier and causing said second planet carrier to rotate internally of the gear casing.

Thus, preferably the output gear mechanism is afforded by or is driven by said second planet carrier.

Preferably the gear casing is secured to the machine housing in a manner in which a limited degree of rotation is permited, means being provided to restrain such rotation, means preferably also being provided to detect such rotation against the action of the restraint, to switch off or reverse the electric motor.

DESCRIPTION OF THE DRAWINGS

The accompanying drawings illustrate a shredding machine which is a preferred embodiment of this invention, having been selected for the purposes of illustrating the invention by way of example.

In the accompanying drawings.

DESCRIPTION OF THE PREFERRED EMBODIMENT

Figure 2:
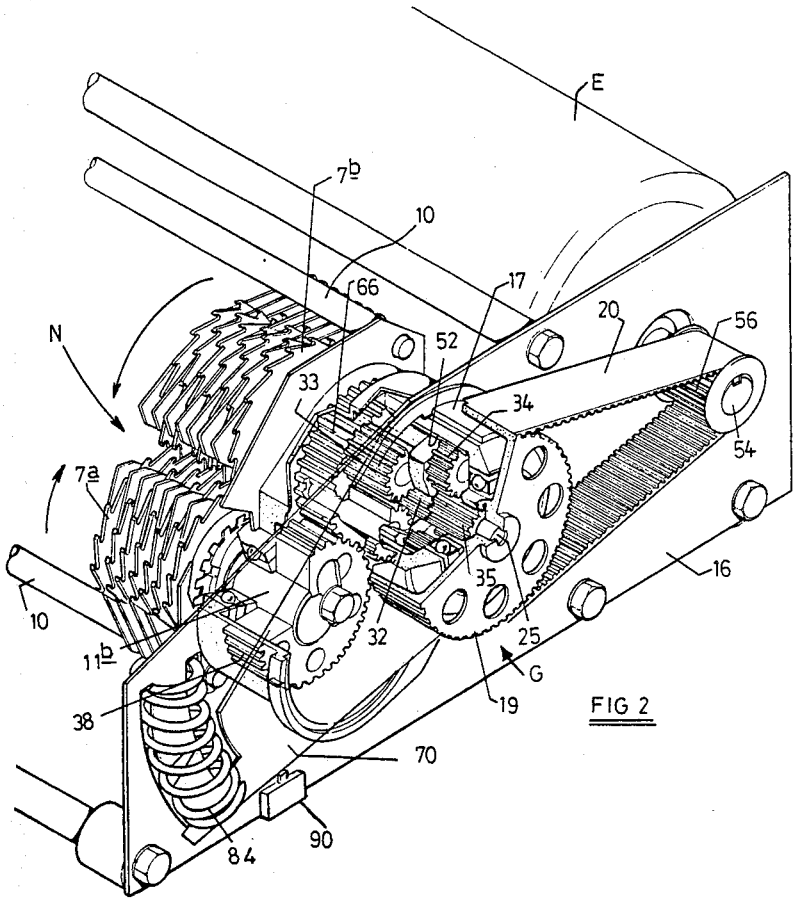
FIG. 2 is a schematic, assembled view of part of the preferred embodiment, specifically illustrating gear mechanism thereof.

With reference to the accompanying drawings, the shredding machine which is the preferred embodiment of this invention is specifically of the kind specified, comprising an electric motor E (FIG. 2) operative to rotate parallel cutter shafts 11*a*, 11*b* in opposite directions through the intermediary of gear mechanism G, the cutter shafts comprising respective arrays of cutter discs 7*a* and 7*b* mounted thereon, which cutter discs intermesh in conventional manner so as to cause, when rotated in the direction of the arrows shown in FIGS. 2, documentary material fed into the nip N (defined by infeed bars 1) to be shredded into strips. Tie rods 10 connected to the machine frame support stripping mechanism in the form of inwardly-facing stripper members 8, operative between adjacent cutter discs, to strip shredded material away from the cutter shafts to prevent the machine becoming jammed. In the preferred embodiment, the cutter discs 7, fixed strippers 8 and circular spacers 9 are secured on their respective shafts by a nut 14, a tab washer 13 and a collar 12.

The gear mechanism G comprises a hollow cylindrical gear casing 17 mounted in an aperture 50 of an end wall 16 of the shredding machine housing, the casing 17 comprising internally-disposed gear teeth 52. Mounted over the casing 17 so as to extend partially around the casing is a drive pulley 19 onto which is splined, internally of the casing 17, a sun gear 35, a spindle 25 extending freely axially through the sun gear.

The electric motor E has an output shaft 54, to which a drive pinion 56 is secured, a belt 20 extending between the drive pinion 56 and the drive pulley 19, to cause the drive pulley to rotate relative to the casing 17.

Located within the casing 17 is a first planet carrier 31 having uniformly disposed stub shafts each of which carries a planet gear 34, said planet gears 34 being in mesh with the gear teeth 52 on the interior of the casing 17 and in mesh with the sun gear 35. Thus rotation of the sun gear 35 causes the planet gears 34 and hence the planet carrier 31, to rotate around the inside of the casing 17.

Spaced axially from the first planet carrier 31 is a second planet carrier 37, comprising five stubs shafts upon which second planets gears 33 are mounted, the planet carrier 31 carrying a second sun gear 32 which meshes with the planet gears 33, causing them to rotate around the inside of the casing 17.

The second planet carrier 37 is located on a keyway on the cutter shaft 11*b* but is additionally provided with a peripheral tooth formation 66 which meshes with a gear wheel 38 to which the cutter shaft 11*a* is mounted, also involving a keyway, the formation 66 and gear wheel 38 constituting further gearing to cause the second cutter shaft 11*b* to rotate at the same speed as, but in the opposite direction to the cutter shaft 11*a*.

The size of the gearing mechanism is such that the speed reduction between the output shaft 54 and the gear wheel 19 is approximately 3:1; between the gear wheel 19 and the first planet carrier 31 is approximately 4:1; and between the first planet carrier 31 and the second planet carrier 37 also approximately 4:1. In this manner a speed reduction of approximately 48:1 is obtained between the electric motor output shaft 54 and the cutter shafts 11*a* and 11*b* and a corresponding increase in torque is produced.

To prevent the casing 17 being rotated by the reverse torque applied thereto by the planet gears, the casing 17 is mounted on a mounting plate 22 having tangs 74 which locate in grooves 76 in the exterior surface of the casing 17. Nuts 40 and bolts (not shown) secure the mounting plate 22 to the end wall 16 of the housing, the bolts passing through slots 78 in the mounting plate 22 and through holes in the end wall 16, and the slots 78 being such as to permit limited rotation of the mounting plate 22 about the axis of the aperture 50.

Figure 1:
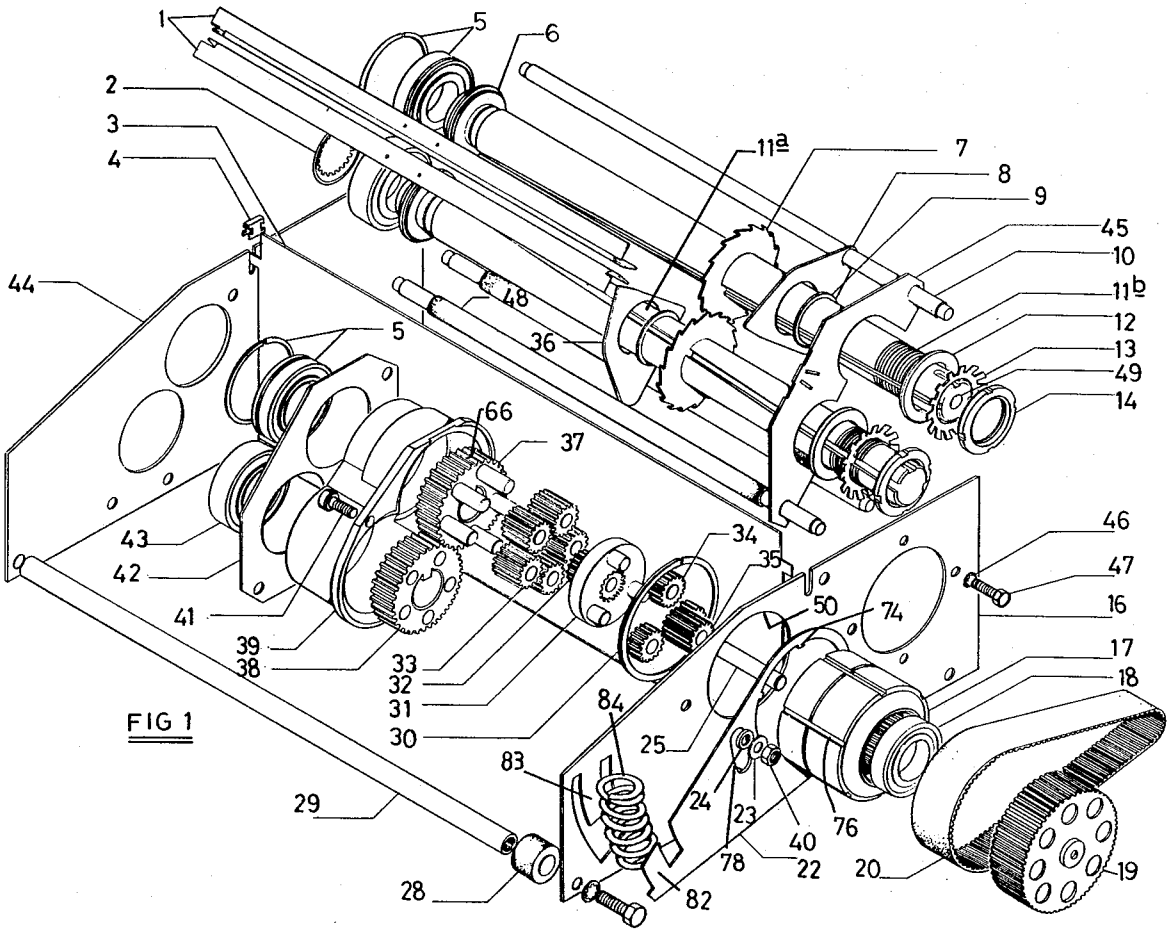
FIG. 1 is a schematic, exploded, perspective view of the preferred embodiment.

Operative between a tongue 82 of the mounting plate 22 and a tongue 83 of the end wall 16 is a strong compression spring 84, which is operative to urge the mounting plate 22 in an anti-clockwise direction (viewed from FIGS. 1 and 2) opposite to the limited movement are permitted by engagement of the bolts with the slots 78. As will be seen from the drawings, the spring 84 acts in the rotary direction opposite to that in which the casing 17 is urged by the planet gears, as a counter torque opposed to the rotating shafts. Thus the strength of the spring 84 is selected to maintain the gear casing 17 in the specified position under normal loading of the cutter mechanism.

However in the event of a significant degree of over loading, such as may be caused by the insertion of a large number of sheets of documentary material into the nip of the shredding mechanism, or by the inadvertent introduction into the nip of material which cannot readily be cut by the cutter discs, the reaction, seen as an increased counter torque on the casing 17, will cause the casing 17 to be rotated in a clockwise direction against the action of the spring 84 through the limited extent permitted by engagement of the bolts within the slot 78. Means, afforded by a micro-switch 90 (FIG. 2) is located to sense such movement of the mounting plate 22 against the action of the spring 84, such movement indicating a serious overload of the machine, the micro-switch being permitted to open and thus be operative to switch off the supply of power to the electric motor E, thus terminating operation of the machine before any significant damage is likely to have been done. Alternative to termination of operation of the machine, if desired actuation of the microswitch may be effective temporarily to reverse rotation of the electric motor E, to cause the jammed material to be ejected rearwardly from the nip, prior to automatically commencing operation of the drive motor in its operative direction.

By the use in the shredding machine of the gear mechanism above described, an electric motor providing an output shaft rotating at high speed but with low torque may be utilised quite satisfactorily, the gear mechanism which is operative to reduce the speed and increase the torque available and being accommodated in a relatively small volume, and thus increasing the size of the machine only a minor extent.

In addition by the use of the epicyclic mechanism, involving the use of a hollow cylindrical member having an internal tooth formation, detection of the tendency of the casing to rotate under a high counter torque can be utilised to protect the electric motor at an early overload stage, with significant reduction in the tendency for damage to be caused.

The provision of the resilient mounting for the epicyclic gear box also permits shock loading, such as may be caused on start up of the machine, significantly to be reduced. Thus, even without the provision of the microswitch 90, significant advantages may be obtained by the use of the construction otherwise described.

In addition, whilst the constraint to rotation of the casing 17 is such as to permit limited rotational movement of the casing due to shock loading at the nip, it will be appreciated that the plate 22 may alternatively or additionally be mounted so as to be capable of moving in the opposite direction against an additional restraint, such as by the use of a spring, in which the shock loading produced by reverse rotation of the motor E is accommodated.

Further, whilst the drive mechanism has been described above for use with a specific form of cutter arrangement, it will of course be appreciated that the drive mechanism may be used to advantage in shredding mechanisms where other forms of cutter assemblies are utilised.

In order to reduce the cost of providing such an epicyclic gear mechanism, intricately shaped components such as the casing 17 with its internally disposed gear teeth 52, sun gear 35, planet gears 33 and 34, planet carriers 31 and 37 with stub shafts and teeth formed integrally thereon, and gears, pulleys, pinions and the like in general, are preferably formed by a sintered metal process, such as may utilise powdered metal alloys. Components so formed have sufficient strength and accuracy for the present application, protection against undue shocks being afforded by the above-described restraining means 84. Furthermore, stub shafts so formed may be of sufficient accuracy to carry the planet gears directly.

LIST OF PARTS

| Reference numeral | Name (quantity in parentheses) |
|---|---|
| 1 | INFEED BARS |
| 2 | PUSH-ON SPIRE WASHERS |
| 3 | BIN FULL FLAP |
| 4 | SPIRE CLIP (2) |
| 5 | RETAINED SHAFT BEARING (2) |
| 6 | LEFT SHAFT COLLAR (2) |
| 7 | CUTTER DISCS |

-continued

LIST OF PARTS

| Reference numeral | Name (quantity in parentheses) |
|---|---|
| 8 | FIXED STRIPPER (130) |
| 9 | STRIPPER SPACER (260) |
| 10 | TIE RODS |
| 11 | CUTTER SHAFTS |
| 12 | RIGHT SHAFT COLLAR (2) |
| 13 | TAB WASHER (2) |
| 14 | NOTCH NUT (2) |
| 16 | RIGHT FRAME END WALL |
| 17 | GEAR CASING |
| 18 | GEAR CASE BEARING |
| 19 | GEARBOX PULLEY, LARGE |
| 20 | DRIVE TOOTH BELT |
| 22 | MOUNTING PLATE |
| 23 | PLAIN WASHER, LARGE (2) |
| 24 | SPACING COLLAR (2) |
| 25 | CENTRE SPINDLE |
| 28 | MOUNTING FOOT (4) |
| 29 | SIDEFRAME TIE ROD (4) |
| 30 | GEARBOX CASING CIRCLIP |
| 31 | 1ST STAGE PLANET CARRIER |
| 32 | 2ND STAGE SUN GEAR |
| 33 | 2ND STAGE PLANET GEAR (5) |
| 34 | 1ST STAGE PLANET GEAR (3) |
| 35 | 1ST STAGE SUN GEAR |
| 36 | FLOATING STRIPPER (130) |
| 37 | 2ND STAGE I/I GEAR PLANET CARRIER |
| 38 | I/I GEAR |
| 39 | GEARBOX COVER |
| 40 | NUT M8 (2) |
| 42 | STRIPPER LOCATING PLATE (2) |
| 43 | SIDE FRAME BEARING (2) |
| 44 | LEFT FRAME END WALL |
| 45 | PAPER GUIDE (2) |
| 46 | SHAKEPROOF WASHER M6 (4) |
| 47 | SCREW M6 × 16 HEX HEAD (4) |
| 48 | STRIPPER BAR SLEEVE (3) |
| 50 | APERTURE |
| 52 | GEAR TEETH |
| 54 | OUTPUT SHAFT |
| 56 | DRIVE PINION |
| 66 | TOOTH FORMATION |
| 74 | TANGS |
| 76 | GROOVES |
| 78 | SLOTS |
| 82 | TONGUE |
| 83 | TONGUE |
| 84 | SPRING |
| 90 | MICROSWITCH |

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

We claim:

1. In a shredding machine of the type including:

(A) a housing, (B) a cutter assembly having a nip through which material to be shredded is fed, a pair of rotatable cutter shafts, and a plurality of cutter discs mounted on each shaft, the discs on one of the shafts being interleaved with the discs on the other of the shafts, and (C) a drive for rotating the shafts in opposite directions, and for rotating the discs to cut the material fed into the nip into narrow strips, the improvement comprising:

(a) said drive including an electric motor and an epicyclic gear mechanism having planet gears, said motor being operative for rotating the shafts through the intermediary of the gear mechanism in an operational mode, said planet gears being predominantly contained within a gear casing that has an interior toothed formation that engages the planet gears;

(b) means for constraining the gear casing against rotation relative to the housing during the operational mode, but permitting limited freedom of rotational displacement of the gear casing relative to the housing in the event that the motor is subjected to an overload; and (c) motor overload sensing means for sensing such limited displacement of the gear casing and for changing the operational mode of the motor in response to such sensed displacement to protect the motor from damage.

2. The improved shredding machine according to claim 1, wherein the motor rotates an output shaft in one circumferential direction in the operational mode, and wherein the motor overload sensing means is operative for rotating the output shaft in the opposite circumferential direction in response to such sensed displacement.

3. The improved shredding machine according to claim 1, wherein the motor overload sensing means terminates the operational mode of the motor in response to such sensed displacement.

4. The improved shredding machine according to claim 1, wherein the gear mechanism includes a first planet carrier for rotatably mounting a first set of the planet gears within the casing in meshing engagement with the interior toothed formation, a drive shaft extending through the casing and driven by the motor, and a first sun gear mounted on the drive shaft and meshingly engaging the first set of planet gears.

5. The improved shredding machine according to claim 4, wherein the gear mechanism includes a second planet carrier for rotatably mounting a second set of the planet gears within the casing, and a second sun gear mounted on the drive shaft and meshingly engaging the second set of planet gears.

6. The improved shredding machine according to claim 5, wherein one of the cutter shafts is driven by both sets of planet gears; and wherein the gear mechanism includes a drive pinion exteriorly of the casing, and a driven pinion driven by the drive pinion; and wherein the other of the cutter shafts is driven by the driven pinion.

7. The improved shredding machine according to claim 1, wherein the constraining means is operative for constantly returning the gear casing to a rest position relative to the housing.

8. The improved shredding machine according to claim 7, wherein the constraining means includes a mounting plate secured to the casing and having an elongated slot therein that extends along the direction of said limited displacement.

9. The improved shredding machine according to claim 8, wherein the constraining means includes a return spring operatively connected between the housing and the gear casing.

10. The improved shredding machine according to claim 8, wherein the sensing means includes an electrical switch actuatable from one state to another during said limited displacement.

* * * * *